US011470878B1

(12) United States Patent
Dargan et al.

(10) Patent No.: US 11,470,878 B1
(45) Date of Patent: Oct. 18, 2022

(54) DUAL-CHAMBERED, HYBRID VAPORIZER SYSTEM FOR CANNABIS AND FLAVORED PRODUCTS

(71) Applicant: THE SOS DESIGN COMPANY LLC, Wilmington, DE (US)

(72) Inventors: Vivek Mikhail Dargan, Pinole, CA (US); Brandon Nelson, Tustin, CA (US); Peter Osborne, Glendora, CA (US)

(73) Assignee: THE SOS DESIGN COMPANY LLC, Wilmington, DE (US)

( * ) Notice: Subject to any disclaimer, the term of this patent is extended or adjusted under 35 U.S.C. 154(b) by 0 days.

(21) Appl. No.: 17/553,180

(22) Filed: Dec. 16, 2021

(51) Int. Cl.

| | |
|---|---|
| ***A24F 40/10*** | (2020.01) |
| ***A24F 40/42*** | (2020.01) |
| ***A24B 15/167*** | (2020.01) |
| ***A24F 40/30*** | (2020.01) |

(52) U.S. Cl.
CPC ..... *A24F 40/10* (2020.01); *A24B 15/167* (2016.11); *A24F 40/30* (2020.01); *A24F 40/42* (2020.01)

(58) Field of Classification Search
CPC ..... A24F 40/10; A24F 40/30; A24F 40/42; A24B 15/167
See application file for complete search history.

(56) References Cited

U.S. PATENT DOCUMENTS

| | | | | |
|---|---|---|---|---|
| 2020/0138113 | A1* | 5/2020 | Rosser | A24F 40/42 |
| 2020/0154766 | A1* | 5/2020 | Jeong | H05B 3/46 |
| 2020/0163382 | A1* | 5/2020 | Trzecieski | A24F 40/46 |
| 2020/0345066 | A1* | 11/2020 | Kim | A24F 40/42 |
| 2021/0337878 | A1* | 11/2021 | Gretton | A24F 40/42 |
| 2021/0378303 | A1* | 12/2021 | Liu | A24F 40/46 |

* cited by examiner

*Primary Examiner* — Hae Moon Hyeon
(74) *Attorney, Agent, or Firm* — Michael L. Greenberg, Esq.; Greenberg & Lieberman, LLC

(57) ABSTRACT

A dual-chambered, hybrid vaporizer device and method of use thereof configured to facilitate the atomization of cannabinoid concentrates and flavoring such as terpenes suspended in a liquid solution. A first chamber, equipped with a ceramic coil, is configured to melt solid or semi-solid THC in the form of crystals, concentrates, or extracts, which is then vaporized for inhalation by a user in a separate chamber below the ceramic. A second chamber equipped with a vertical metallic coil then vaporizes flavorings such as terpenes which are suspended in the liquid solution. A single air passageway is employed to direct air through both chambers in a serial fashion before exiting the device through a mouthpiece. The device facilitates measured dosages of THC for inhalation by the user.

11 Claims, 8 Drawing Sheets

Section A-A

Section B-B

DUAL-CHAMBERED, HYBRID VAPORIZER SYSTEM FOR CANNABIS AND FLAVORED PRODUCTS

FIELD OF THE PRESENT INVENTION

The present invention relates to the field of personal vaporizers configured to, within the same event, atomize two different compounds, one in a solid or semi/solid state and the other in a liquid state, into particulates for inhalation by a user. More specifically, it relates to a system and apparatus configured to first atomize a solid or semi-solid cannabis derivative in a first chamber and then, at the same time atomize a liquid cannabis derivative in a second chamber. The atomized particulates from the first chamber are conveyed to the second chamber, where they combine with the atomized particulates from the second chamber, for inhalation by a user.

BACKGROUND OF THE PRESENT INVENTION

The atomizers employed in the atomization of substances for inhalation have become more efficient and effective in every way, from the electronic control systems involved in atomizing and the delivery of specific user experiences, to the form factors designed and materials used to deliver the assembled device.

In recent years, vaporizers have been designed to atomize cannabis derivative substances, such as Tetrahydrocannabinol (THC), Cannabidiol (CBD), and other cannabinoids. The most common vaporization devices used in the consumption of cannabis derivatives atomize a solution consisting of many different compounds, of which the primary compounds are THC and naturally occurring terpenes. These devices used to atomize cannabis derivatives suffer from performance limitations owing to the composition of the derivatives themselves, which consist of compounds that volatilize at widely different temperatures. Additionally, at room temperature, some of the compounds are in solid form while others are in liquid form. Our invention not only accounts for these variables, but in fact relies on these differences to deliver end-user specified experiential outcomes.

THC compounds volatilize at much higher temperatures than most terpene solutions. Currently available vaporization devices are unable to separately accommodate these differences because they are designed to volatilize both compounds contained in a single solution and at a common temperature. Consequently, neither compound volatilizes at its optimal temperature, leaving end users unable to experience the unique properties and attributes of all compounds in the proportional amounts desired.

Without control over the vaporization profile of the THC compound, end-users are unable to control critical aspects of their vaporization experiences, because they inhale either too little, requiring multiple uses over time, or too much, causing potentially undesirable, temporarily irreversible consequences which they might realize too late. Neither outcome is favorable to end users.

Many vaporizer devices available on the market are prone to leaking and/or clogging. This is due in part to the nature of their design. Currently, vaporizers utilize a liquid solution in a sealed container which is absorbed through a material that is in contact with a heating element. During use, a vacuum builds within the liquid chamber of the cartridge or pod. This vacuum restricts the flow of the substance through the absorbent material and coil. If the vacuum is not sufficient to prevent unwanted flow of the substance through the coil apparatus, then a leak and clogging can occur. While we utilize this principle in one part of our design, we need to incorporate the exact opposite effect in another. While melting, then atomizing a solid/semi-solid substance, the design requires that the inside of the chamber remain at equilibrium with the outside atmospheric pressure. For such devices to function, enough of the product must be melted for vaporization.

Ideally, when the coil and heating element are initiated, a metallic coil heats up a porous ceramic disc and some of the solid/semi-solid substance is heated above its melting temperature into a liquid which is then absorbed into a ceramic plate. The coil is then able to atomize this liquid as it flows through the ceramic. This process also results in the air inside the chamber to heat up considerably. If the chamber were sealed, there would be a substantial increase in air pressure inside the chamber. A problem occurs when, after enough heat is applied to the coil to substantially heat the product to melt and ultimately vaporize, the user then stops heating the coil after use. The coil quickly cools below the atomization temperature, however the ceramic plate, does not cool at a significant enough rate to immediately re-solidify the substance, and therefore, the product remains in its liquid state for a prolonged duration of time, even once power to the device is ceased. The increased air temperatures within the chamber, without the user atomizing the liquid created, causes pressure to build within the system. The pressure directs the melted product out and away from the coil and ceramic, which may ultimately clog the system. If there were a way in which such pressure could be relieved without the potential for the melted product to leak from the device, clogs could be eliminated or severely minimized.

If there were a device that could regulate the proportional amount of both substances to be atomized and inhaled, end users would have more control over their THC intake from the first chamber, and the flavor profile provided by the terpenes and/or other compounds from the second chamber. Such a device does not currently exist in the marketplace.

There is market demand for a new form of a vaporization device configured to separately and simultaneously atomize THC compounds and the terpenes solution at their optimal temperatures. Such a configuration will provide end users with control over the amount of THC atomized.

This device preferably employs a dual-chambered structure, configured to atomize THC compounds within a first chamber, at a higher temperature, and atomize terpene solutions within a second chamber at a separate lower temperature. Additionally, such a device is preferably configured to employ time, temperature, and power settings to control the quality and quantity of both THC compounds and terpene solutions supplied to the end user; this in turn provides the user with more control over their overall cannabis-related vaporizing experience. Additionally, such a device is equipped with an air vent configured to prevent clogging due to a pressure buildup within the chamber.

SUMMARY OF THE PRESENT INVENTION

The present invention is a dual-chambered vaporizing apparatus and system configured to atomize cannabis compounds in both solid and semi solid form, as well as cannabinoids such as terpenes and/or non-cannabis flavoring compounds in a liquid solution. A first chamber is configured to house solid or semi-solid THC compounds placed atop a porous ceramic plate configured to be heated such that sequentially, the compound is first melted into a liquid state, which is then absorbed through the ceramic plate, and atomized upon making direct contact with the heating element contained within the ceramic plate. The resulting vapor is then drawn by the user's inhalation through to a second chamber configured to atomize a liquid solution containing flavoring, terpenes, or other soluble enhancement solutions. The design of the top of the apparatus is such that the atomizing chamber, housed in a shared framework, may be removed together within the shared framework, or separately, as single units for disposal and replacement when either is emptied from use. An electronic chip or chips, separately regulates the voltage supplied to the first atomizer of the first chamber and the second atomizer of the second chamber.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

The following brief and detailed descriptions of the drawings are provided to explain possible embodiments of the present invention but are not provided to limit the scope of the present invention as expressed herein this summary section.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

The present invention will be better understood with reference to the appended drawing sheets, wherein.

DETAILED DESCRIPTION OF THE PREFERRED EMBODIMENT

The present specification discloses one or more embodiments that incorporate the features of the invention. The disclosed embodiment(s) merely exemplify the invention. The scope of the invention is not limited to the disclosed embodiment(s).

References in the specification to "one embodiment," "an embodiment," "an example embodiment," etc., indicate that the embodiment described may include a particular feature, structure, or characteristic, but every embodiment may not necessarily include the particular feature, structure or characteristic. Moreover, such phrases are not necessarily referring to the same embodiment, Further, when a particular feature, structure, or characteristic is described in connection with an embodiment, it is submitted that it is within the knowledge of one skilled in the art to affect such feature, structure, or characteristic in connection with other embodiments whether or not explicitly described.

The present invention is a vaporizer apparatus configured to facilitate the flavorful and effective vaporization of cannabis products by a user. The apparatus is equipped with a top portion (10), and a bottom portion (20).

The top portion (10) is conventionally referenced as a "pod," and is configured to contain the substances to be vaporized for inhalation by the user. The top portion (10) is configured to be removably attached to the bottom portion (20) via at least one magnet or other locking device (150).

Figure 1:
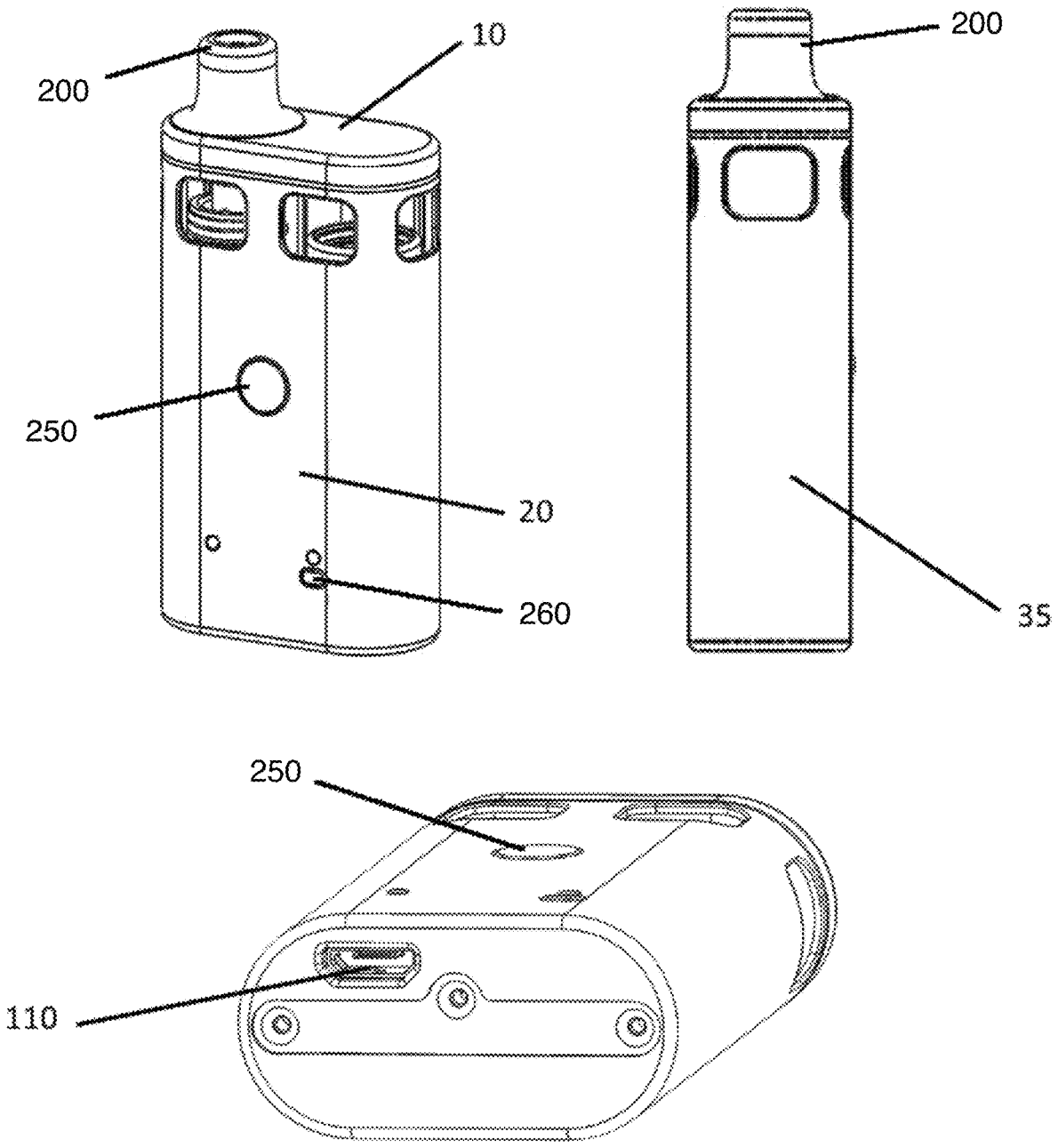
FIG. 1 depicts the apparatus of the present invention as seen from the front, side and rear.
Figure 2:
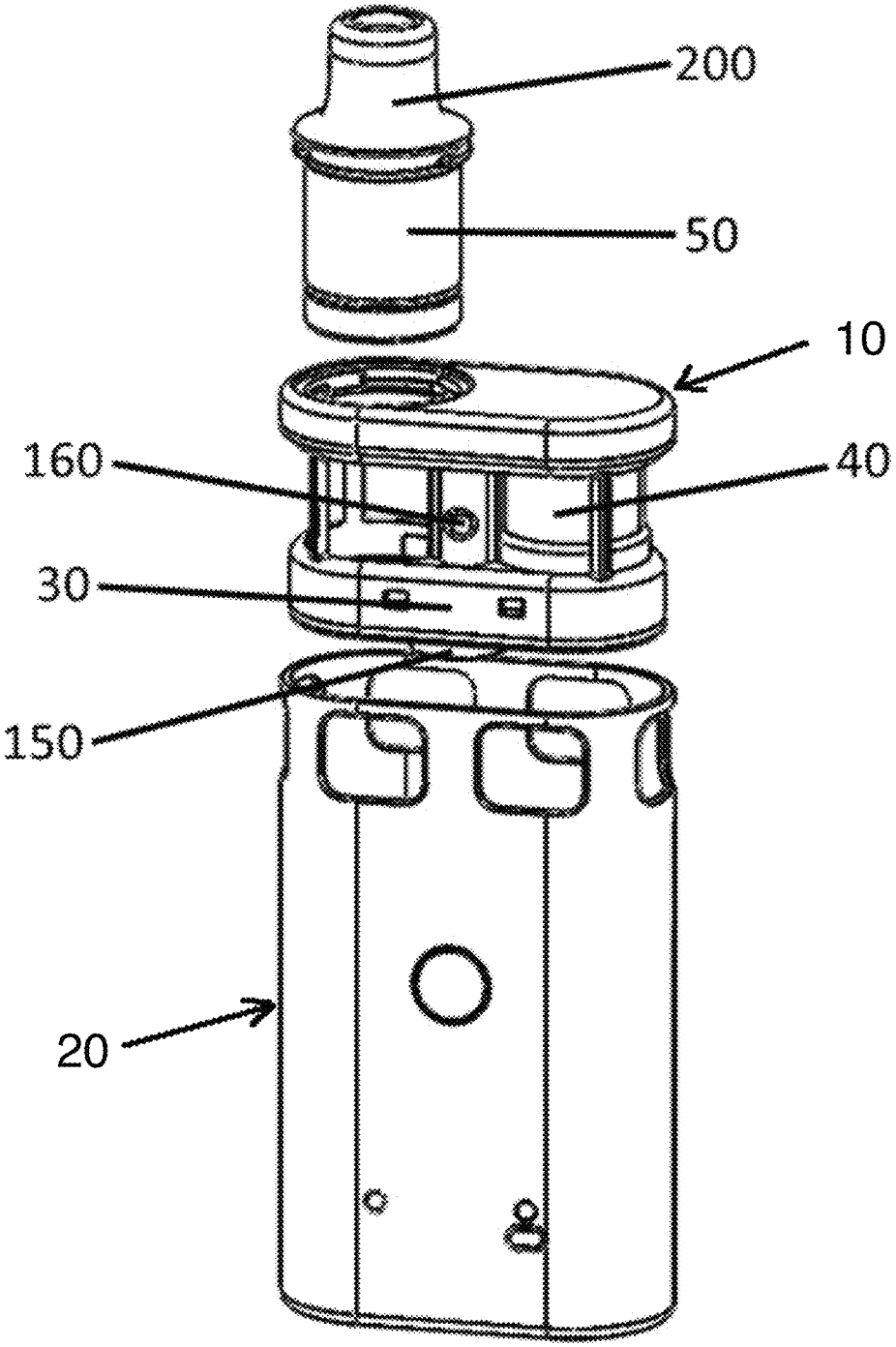
FIG. 2 shows an exploded view of the first and second chamber of the top portion and the bottom portion of the present invention.
Figure 3:
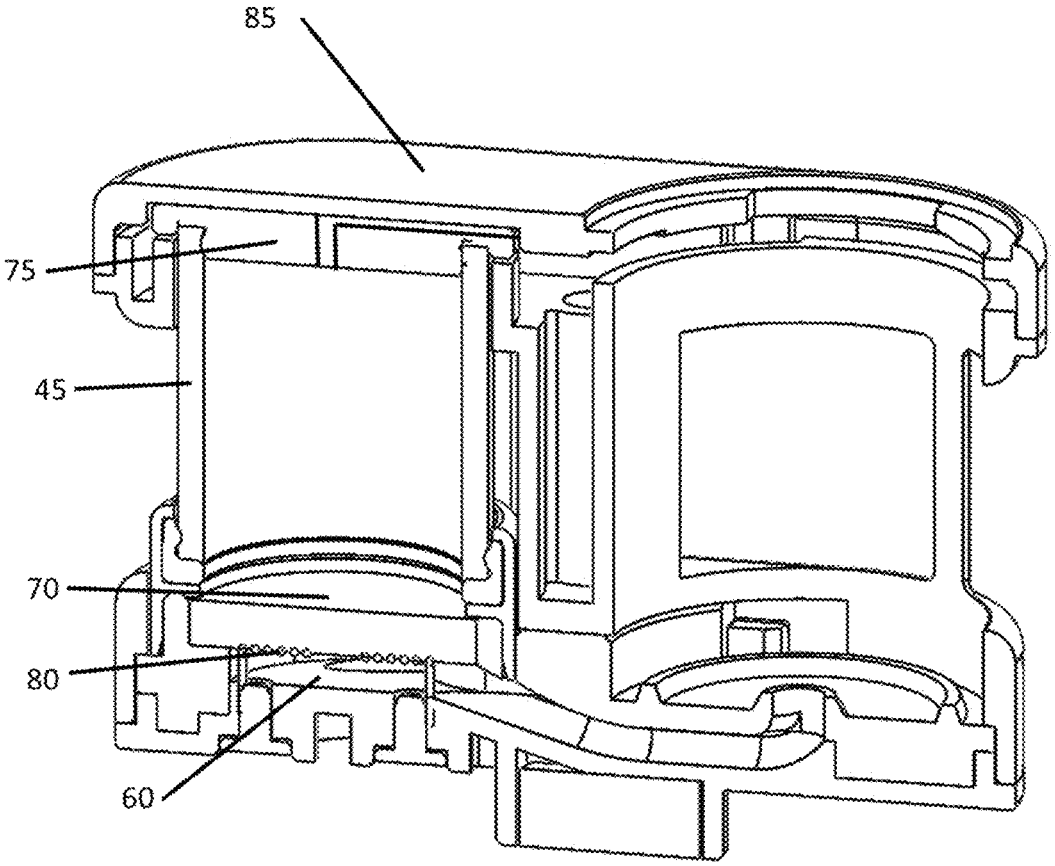
FIG. 3 exhibits a close-up, cutaway view of the first chamber of the top portion of the present invention.
Figure 4:
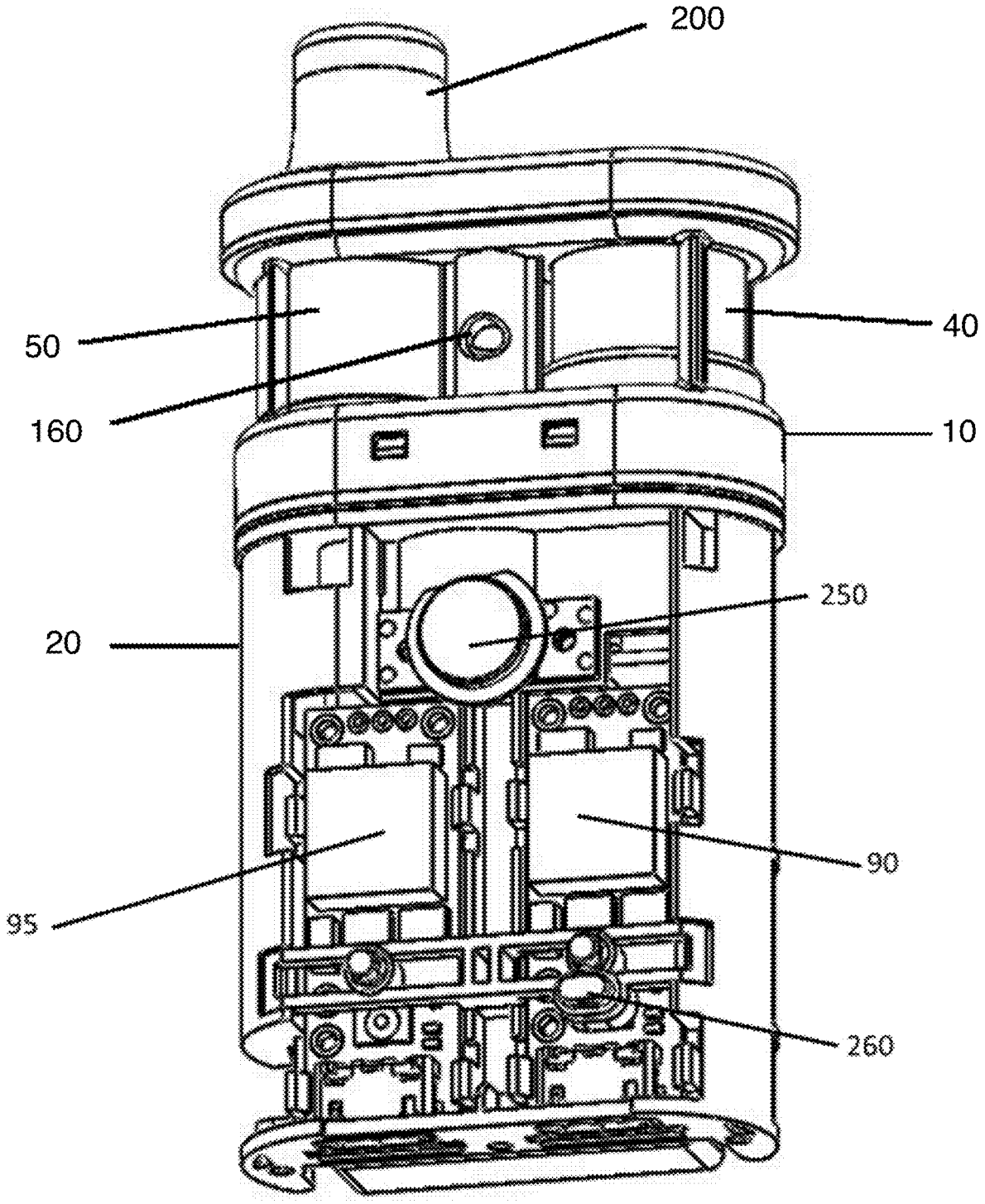
FIG. 4 exhibits a transparent perspective view of the front of the present invention.
Figure 5:
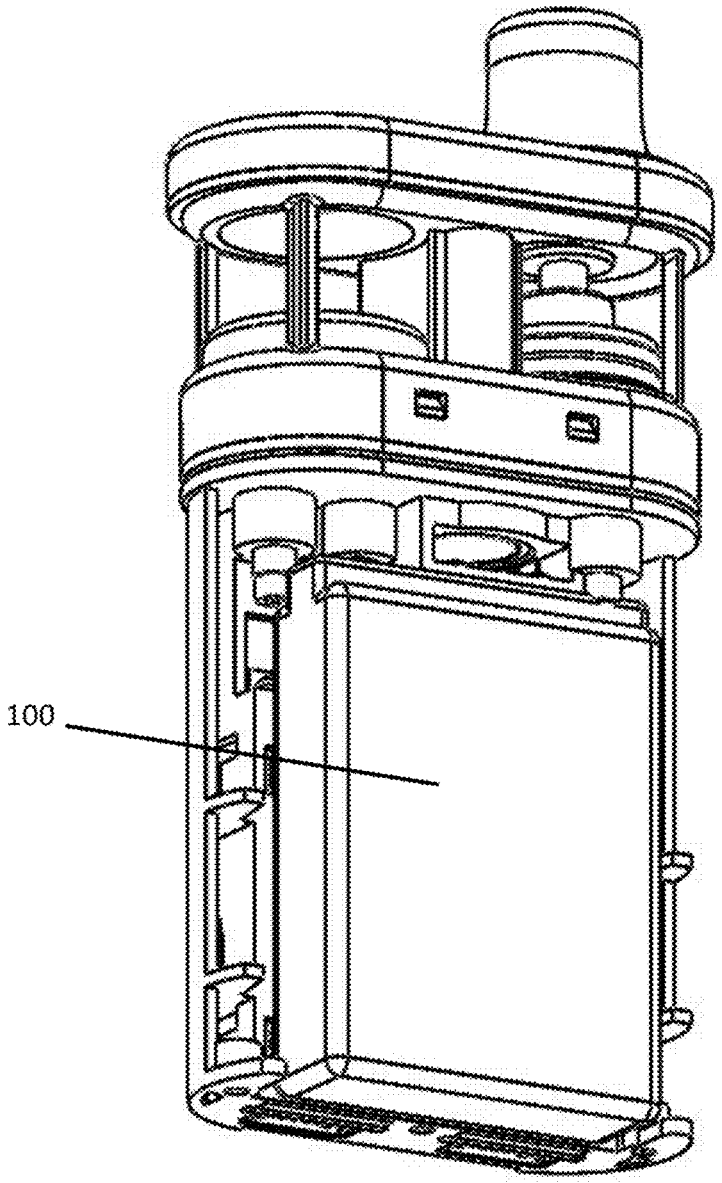
FIG. 5 shows a transparent perspective view of the rear of the present invention.
Figure 6:
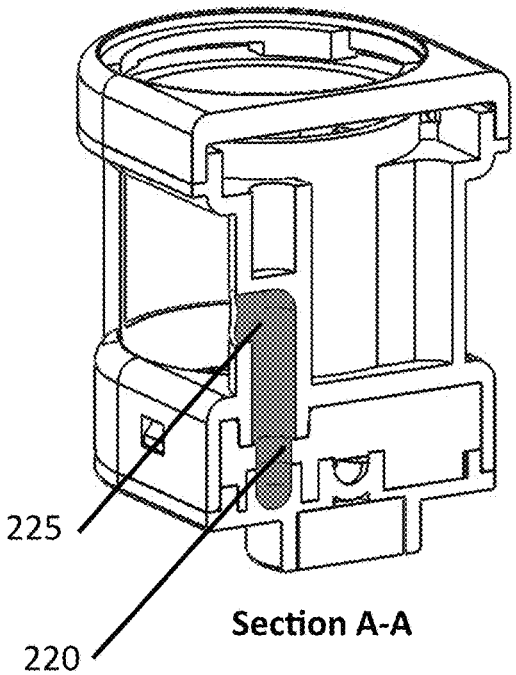
FIG. 6 depicts a cutaway view of the top portion of the present invention, depicting an the conduit, with a portion of cut off from the same piece to better show the same conduit. A-A, shown at the top left of FIG. 6, shows a cross-section reflected in the cutlines A-A, and B-B, shown at the bottom of FIG. 6, shows a cross-section of the top section reflected in the cutlines B-B, all depicting the same continuous conduit of the present invention extending from an air intake, then to a first chamber, then to a second chamber, and finally extending to an exit point.
Figure 6:
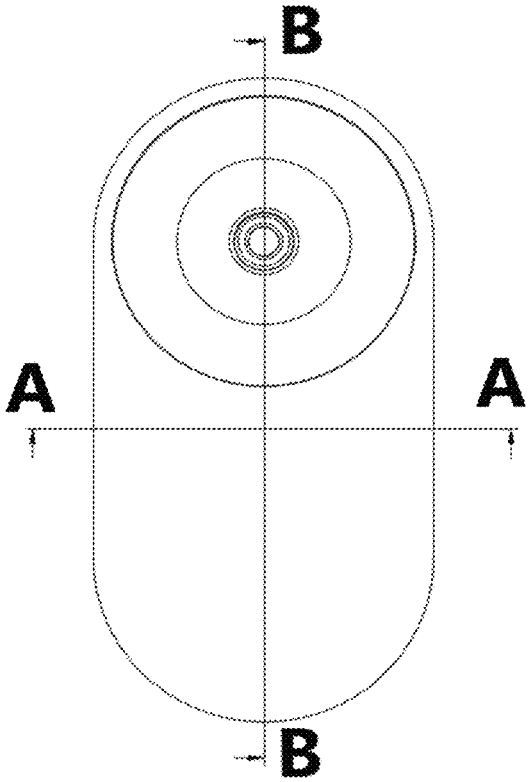
Figure 6:
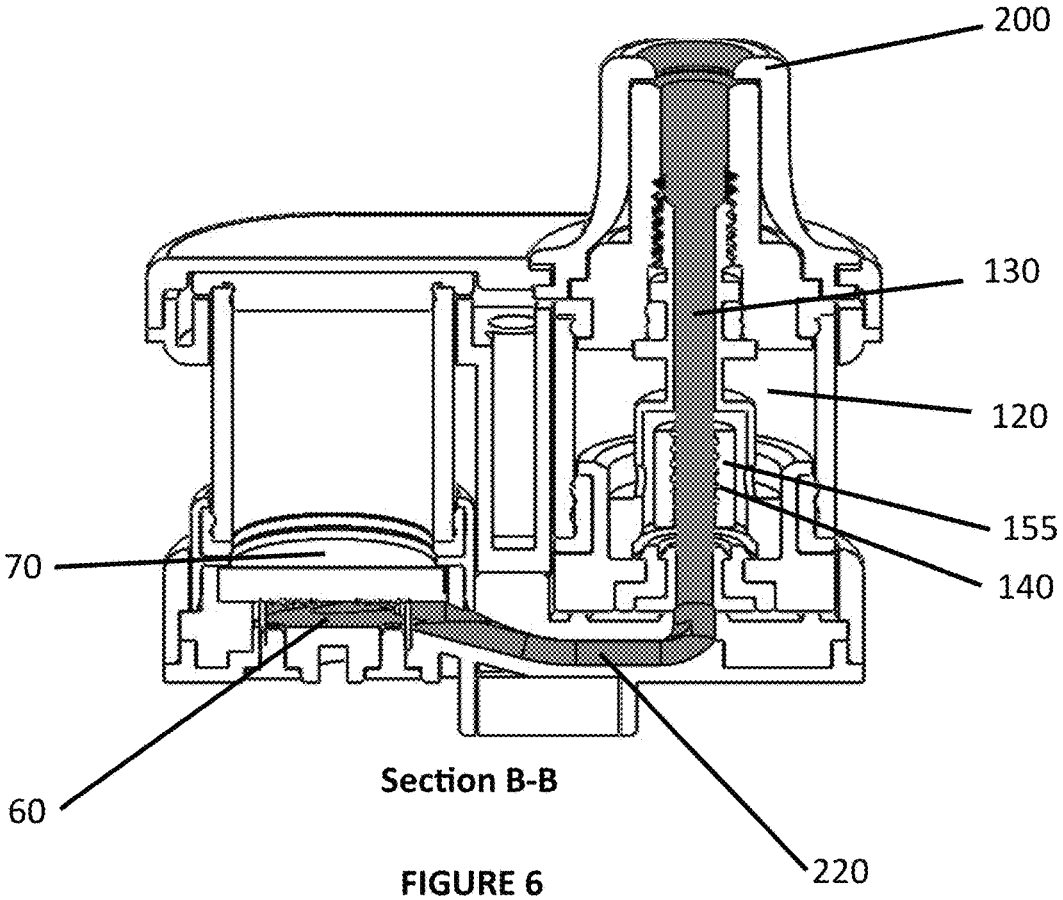
Figure 7:
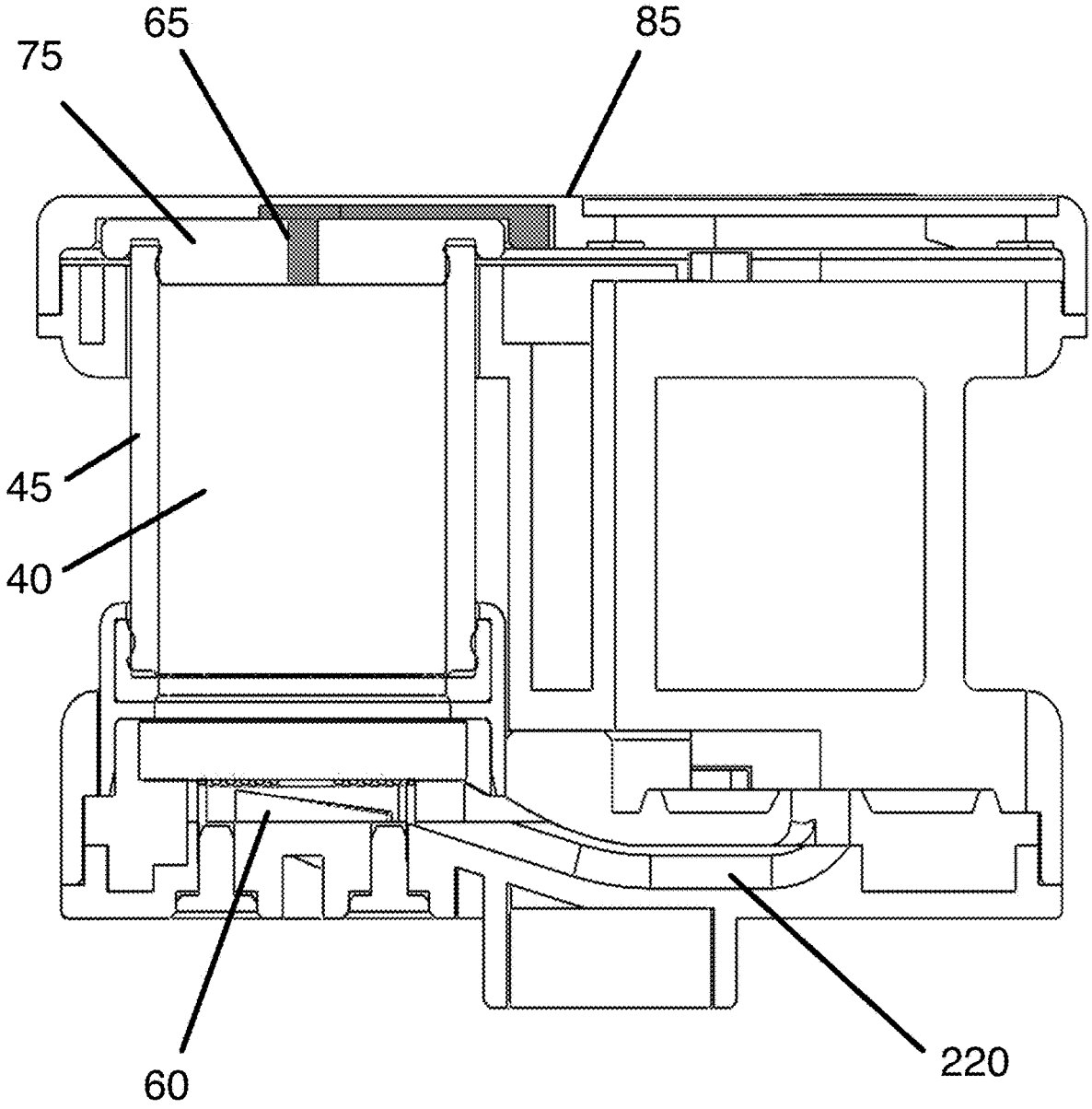
FIG. 7 depicts a detailed view of the pressure equilibrium pathway of the first chamber of the present invention, shown in a cut perspective view from the side.
Figure 8:
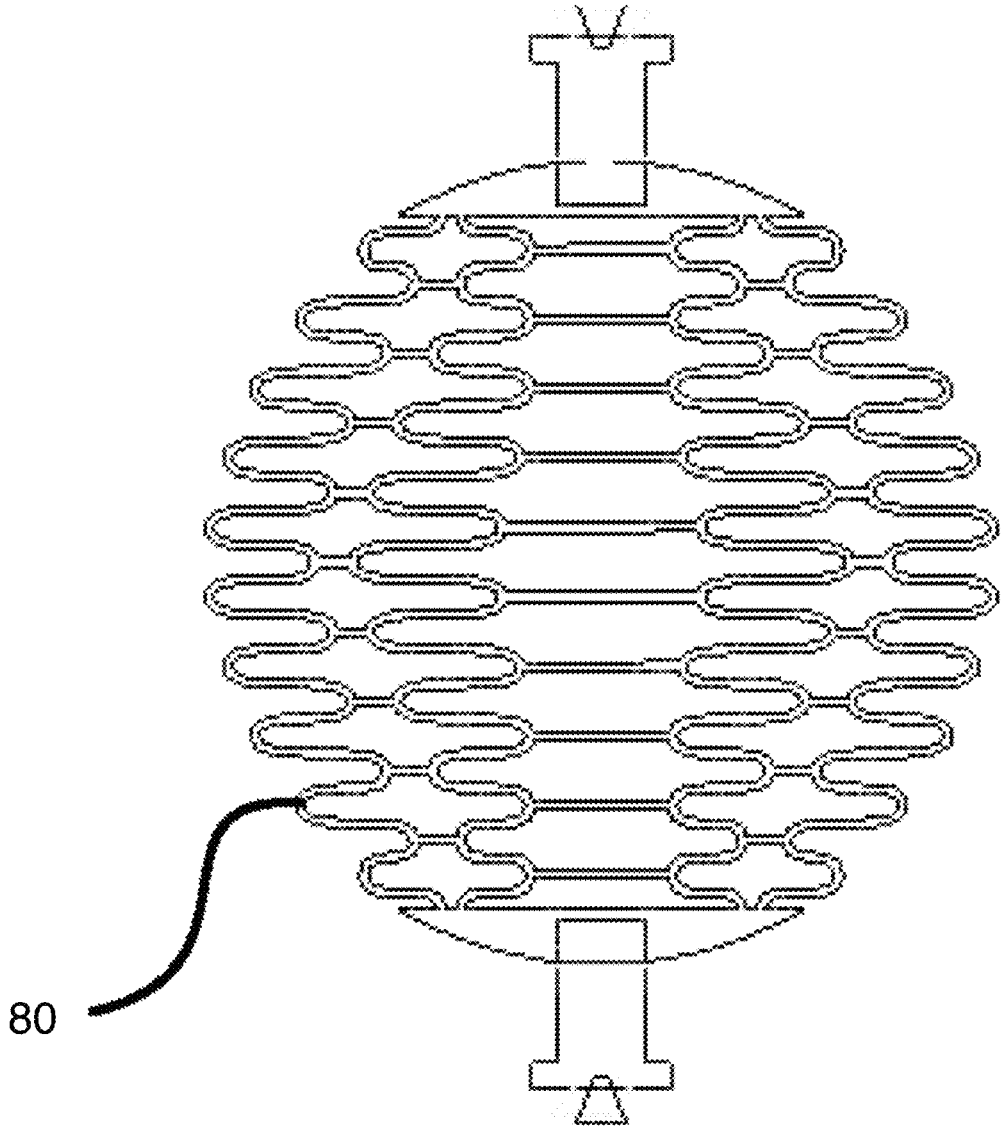
FIG. 8 shows a view of a bottom of the first metallic coil of the first chamber of the apparatus of the present invention.

The top portion (10) is equipped with a housing (30) containing a first chamber (40) and a second chamber (50), as well as an air intake (160). The first chamber (40) is equipped with an air circulation platform (60) disposed beneath a disc shaped ceramic heating element (70). The ceramic heating element (70) is heated via a first metallic coil (80), shown in FIG. 8, disposed underneath or within the ceramic heating element (70). The first metallic coil (80) is preferably arranged such that it heats away from the center of the ceramic heating element (70), as no portion of the wire of the first metallic coil (80) is disposed at the center of the ceramic heating element (70). Cannabis concentrates in crystalline form, such as "Diamonds," "wax," "shatter," or similar solid or semi-solid concentrate formats is disposed atop the ceramic heating element (70) within the first chamber (40). A cylindrical wall (45) in the form of glass, ceramic, or quartz may be present around the ceramic heating element (70) within the first chamber (40) of the present invention to contain the concentrate above the ceramic heating element (70). A silicone top cap (75) with an air pressure relief hole to outside ambient pressure is preferably disposed above the wall (45) to ensure that the concentrate remains in place and equalizes air pressure from the heating of the concentrate. The air pressure relief hole, referenced as air vent (65), ensures the prevention of a positive pressure build-up, helping to prevent clogs. A tamper-proof cap (85) is present over the silicone top cap (75) to prevent user access to the first chamber (40). The air vent (65) is positioned so as to prevent any and all leakage of melted or semi-liquid product from the first chamber (40).

The first metallic coil (80) is preferably composed of a metallic alloy conducive to temperature regulation by communication with a first regulatory chip (90) which is configured to convey power to the first metallic coil (80) as provided via a power source (100) in a regulated fashion such that the wattage provided to the first metallic coil (80) is consistent despite the voltage present within the power source (100) to maintain a specific prescribed resistance of the metallic coil (80) resulting in a desired temperature of the metallic coil (80).

The second chamber (50) of the present invention is disposed adjacent to the first chamber (40), and is equipped with a tank (120), chimney (130), and a second metallic coil (140). The second metallic coil (140) is disposed in a vertical orientation and is preferably surrounded by an absorbent material (155) such as ceramic. The tank (120) contains a flavored solution, preferably composed of and/or exhibiting qualities of terpenes derived from *cannabis*. The second metallic coil (140) is preferably composed of a metallic alloy conducive to temperature regulation by communication with a second regulatory chip (95) which is configured to convey power to the second metallic coil (140) as provided via a power source (100) in a regulated fashion such that the wattage provided to the second metallic coil (140) is consistent despite the voltage present within the power source (100) to maintain a specific prescribed resistance of the metallic coil (140) resulting in a desired temperature of the metallic coil (140) and is preferably in a position adjacent to the first regulatory chip (90).

The power source (100) of the present invention is housed within the bottom portion (20) of the present invention and is preferably a lithium-ion rechargeable battery. It is envisioned that the power source (100) is not preferably configured to be removable by the end-user for external recharging. As such, a USB Universal Serial Bus (USB) port (110) is preferably disposed on a bottom of the bottom portion of the present invention to facilitate recharging of the power source (100) of the present invention. The USB port (110) is additionally configured to enable connection of the present invention to a computer. When connected to a computer via the USB port (110), the second regulatory chip (95) is configured to relay usage data to a secured server computer for diagnostic records.

The top portion (10) is removable from the bottom portion (20) and is preferably disposable. The housing (30) of the top portion is equipped with an air intake (160). The second chamber (50) is equipped with a mouthpiece (200) and the mouthpiece (200) functions as a locking mechanism to top portion housing (30) as well as the exit point for a conduit (220) which extends to the air intake (160). The conduit (220) traverses from the air intake (160) to the mouthpiece (200) (colloquially referenced as a drip tip) by extending into the housing (30) before taking a 90-degree downward bend (225), followed by a tapered turn towards the first chamber (40). The conduit (220) is then expanded to the air circulation platform (60) disposed beneath the ceramic heating element (70). The angle at which the conduit (220) enters the air circulation platform (60) is preferably a helix angle which ensures that air is forced around the circumference of the air circulation platform (60) before exiting the air circulation platform (60). As air exits the air circulation platform (60) it is pulled downwards at an acute angle exhibiting no hard corners to minimize any buildup of condensation prior to entering the second chamber (50) of the top portion (10) of the present invention. The conduit (220) then extends up and through the second metallic coil (140) and chimney (130) before exiting the second chamber (50) of the top portion (10) via the mouthpiece (200).

The bottom portion (20) is equipped with a bottom portion housing (35) and contains the first regulatory chip (90), second regulatory chip (95), and power source (100). A fire button (250) is present on an exterior of the bottom portion housing (35) and is configured to simultaneously activate both the first regulatory chip (90) and second regulatory chip (95), powering both the first metallic coil (80) and second metallic coil (140). The power supplied by first regulatory chip (90) from the power source (100) to the first metallic coil (80) is preferably adjustable by the user via a power control button (260) to three different settings: a low setting, a medium setting, and a high setting. The settings correspond to the amount of THC provided from the first chamber (40) to the user, enabling the user to adjust the dosage supplied by the present invention. The settings are configured to control the wattage supplied to the first metallic coil (80) as well as the duration of time to which the power is supplied to the coil. The power control button (260) of the present invention is preferably equipped with a preheat function option, making the power control button (260) a multi-function button. Users may press the power control button (260) two times to activate the preheat function. The preheat function is configured to melt the substance of the first chamber (40) such that it may then be absorbed into the ceramic but is not vaporized. Then, upon holding down a fire button (250), the substance within the absorbent ceramic heating element (70) is vaporized upon contact with the first metallic coil (80) disposed beneath or within the ceramic heating element (70).

The power supplied to the second metallic coil (140) is a predetermined heat curve and is therefore not adjustable by the user. It should be noted that the temperature of the first metallic coil (80) is higher than that of the second metallic coil (140) when the fire button (250) is pressed by the user. While subject to change, the preferred temperature of the ceramic heating element (70), as provided by the first metallic coil (80) is quickly heated to preferably 300-350, while the first metallic coil (80) is instantly heated to preferably 400-450 degrees Fahrenheit. In contrast, the second metallic coil (140) is preferably configured to fire to approximately 150-380 degrees Fahrenheit over a predetermined heat curve. The metallic alloys employed in the first metallic coil (80) and second metallic coil (140) is preferably that of titanium alloys, nickel silver alloys, or a Kanthal with a high nickel content. It should also be understood that the air flow through the top portion (10) of the present invention is such that air first travels through the first chamber (40) and then to the second chamber (50) in a serial fashion. It should further be noted that the first metallic coil (80) and second metallic coil (140) of the present invention amount to a first ignition device and second ignition device, each configured to be heated to differing temperatures in accordance with the differing substances disposed in each the first chamber (40) and second chamber (50).

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A vaporizer apparatus, comprising:

A first coil disposed in electrical communication with a power source;

a first chamber, said first chamber containing said first coil;

an air vent, said air vent in fluid communication with said first chamber;

a second chamber, said second chamber containing a second coil disposed in electrical communication with said power source;

a conduit extending between said first chamber and said second chamber, connecting said first chamber to said second chamber;

wherein said conduit begins at an air intake which first draws air into said first chamber before passing the air to said second chamber via said conduit;

wherein said conduit is disposed between said air intake and an exit point located at a top of said second chamber;

wherein said first chamber is configured to heat to a first temperature.

2. The vaporizer apparatus of claim 1, wherein said conduit is configured to intake a first substance from said first chamber.

3. The vaporizer apparatus of claim 2, wherein said conduit is configured to intake a second substance from said second chamber without allowing said first substance to leak into said second chamber.

4. The vaporizer apparatus of claim 1, wherein said conduit is configured to intake a second substance from said second chamber.

5. The vaporizer apparatus of claim 1, wherein said second chamber is configured to heat to a second temperature.

6. The vaporizer apparatus of claim 5, wherein said first temperature and said second temperature are different.

7. The vaporizer apparatus of claim 1, wherein said conduit is configured to intake a first substance from said first chamber.

8. The vaporizer apparatus of claim 7, wherein said conduit is configured to intake a second substance from said second chamber without allowing said first substance to leak into said second chamber.

9. The vaporizer apparatus of claim 1, wherein said conduit is configured to intake a second substance from said second chamber.

10. A vaporizer apparatus comprising:

a first chamber;

an air vent, said air vent in communication with said first chamber;

a second chamber;

a conduit extending between said first chamber and said second chamber, connecting said first chamber to said second chamber;

wherein said conduit has an air intake disposed adjacent to, and in communication with said first chamber; and wherein said conduit continues extending between said second chamber and an exit point;

wherein said exit point is a mouthpiece;

wherein said first chamber is configured to heat to a first temperature; and wherein said second chamber is configured to heat to a second temperature.

11. The vaporizer apparatus of claim 10, wherein said first temperature and said second temperature are different; and wherein said conduit traverses from said air intake to said mouthpiece.

* * * * *